US005570864A

United States Patent [19]

Flores

[11] Patent Number: 5,570,864

[45] Date of Patent: Nov. 5, 1996

[54] ADJUSTABLE ROOFING STOOL

[76] Inventor: Juan R. Flores, 6411 Spencer Hwy., Apt. 177, Pasadena, Tex. 77505-1732

[21] Appl. No.: 242,649

[22] Filed: May 13, 1994

[51] Int. Cl.[6] ..... A47G 29/02

[52] U.S. Cl. ..... 248/148; 248/237

[58] Field of Search ..... 248/148, 237, 248/371, 397, 398

[56] References Cited

U.S. PATENT DOCUMENTS

| | | | |
|---|---|---|---|
| 955,159 | 4/1910 | Hillman | 248/237 X |
| 1,028,362 | 6/1912 | King | 248/237 X |
| 1,471,947 | 10/1923 | Cornelius | 248/237 X |
| 2,782,034 | 2/1957 | Donoghue | 248/148 X |
| 2,888,225 | 5/1959 | McQuin | 248/237 |
| 4,401,184 | 8/1983 | Sherry | 248/237 X |
| 4,826,122 | 5/1989 | Cupp | 248/237 |
| 4,917,345 | 4/1990 | Czech | 248/678 |

*Primary Examiner*—Leslie A. Braun
*Assistant Examiner*—Catherine S. Collins

[57] ABSTRACT

An adjustable roofing stool for supporting a person and materials on a pitched roof comprising a pedestal adapted to be placed in contact with the surface of a pitched roof; a seat adapted for supporting personnel and materials thereon; a coupling mechanism for pivotally coupling the pedestal to the seat; a positioning mechanism coupled between the pedestal and seat for fixing the angular orientation of the seat relative to the pedestal; and a securable mechanism for coupling the pedestal to the surface of a pitched roof for maintaining the pedestal at given location.

2 Claims, 3 Drawing Sheets

ADJUSTABLE ROOFING STOOL

BACKGROUND OF THE INVENTION

1. Field of the Invention

The present invention relates to an adjustable roofing stool and more particularly pertains to supporting a person and materials on a pitched roof with an adjustable roofing stool.

2. Description of the Prior Art

The use of roof supports is known in the prior art. More specifically, roof supports heretofore devised and utilized for the purpose of supporting a person and materials on a roof are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,842,229 to Murray discloses a paint bucket holder. U.S. Pat. No. 4,962,906 to Fatool et al. discloses a paint can holder. U.S. Pat. No. 4,987,720 to Wozney, Jr. discloses a non-skid holder for shingles for use on a pitched roof. U.S. Pat. No. 5,004,072 to Launer discloses a work platform apparatus for roofs. U.S. Pat. No. 5,165,642 to Rihaly discloses a shingle holder.

While these devices fulfill their respective, particular objective and requirements, the aforementioned patents do not describe an adjustable roofing stool that has a pivotal seat and a pedestal with a storage pocket for storing tools.

In this respect, the adjustable roofing stool according to the present invention substantially departs from the conventional concepts and designs of the prior art, and in doing so provides an apparatus primarily developed for the purpose of supporting a person and materials on a pitched roof.

Therefore, it can be appreciated that there exists a continuing need for a new and improved adjustable roofing stool which can be used for supporting a person and materials on a pitched roof. In this regard, the present invention substantially fulfills this need.

SUMMARY OF THE INVENTION

In the view of the foregoing disadvantages inherent in the known types of roof supports now present in the prior art, the present invention provides an improved adjustable roofing stool. As such, the general purpose of the present invention, which will be described subsequently in greater detail, is to provide a new and improved adjustable roofing stool and method which has all the advantages of the prior art and none of the disadvantages.

To attain this, the present invention essentially comprises a pedestal. The pedestal includes a rectangular base plate having opposed top and bottom edges, opposed side edges, a top surface, and a bottom surface with the bottom surface adapted to be placed in contact with the surface of a pitched roof. The pedestal includes a pair of parallel, symmetrically spaced, and triangularly-shaped outer legs with each outer leg having an upper edge, a lower edge, and a rear edge defined about its periphery, a front corner defined between the upper edge and the lower edge, a lower corner defined between the lower edge and the rear edge, and an upper corner defined between the upper edge and the rear edge with the rear edges coupled to the top surface of the base plate near the side edges thereof, the outer legs further having a pair of symmetrically aligned pivot holes with each pivot hole disposed on each outer leg near the upper corner thereof and a plurality of symmetrically aligned pairs of adjustment holes with the adjustment holes disposed and spaced in curvature with respect to the pivot hole on each outer leg between the front corner and the rear edge thereof. Lastly, the pedestal includes a cross bar coupled across the lower edges of each outer leg near the lower corner thereof with the cross bar, outer legs, and base plate defining an essentially storage pocket adapted for holding tools and equipment therein.

A seat is included. The seat has a rectangular and planar plate having opposed top and bottom edges, opposed side edges, a top surface, and a bottom surface with the top surface of the plate adapted to support a person and materials thereon. The seat includes a pair of parallel, symmetrically spaced, and triangularly-shaped inner legs with each inner leg having a top edge, a bottom edge, and a front edge defined about its periphery, a front corner defined between the top edge and the front edge, a bottom corner defined between the front edge and the bottom edge, and a rear corner defined between the top edge and bottom edge with the top edges coupled to the bottom surface of the seat near the side edges thereof, the inner legs further having a pair of symmetrically aligned adjustment holes with each adjustment hole disposed on each inner leg near the bottom corner thereof and a pair of symmetrically aligned pivot holes with each pivot hole disposed on each inner leg near the rear corner thereof. Lastly, the seat includes an elongated support bar coupled between the inner legs near the bottom corners thereof.

Coupling means are included and disposed within the pivot holes on the pedestal and the pivot holes on the seat for pivotally coupling the pedestal to the seat. Positioning means are included and disposed within a pair of adjustment holes on the pedestal and the adjustment holes on the seat for fixing the angular orientation of the seat relative to the pedestal. Lastly, an elongated hinge is included and has one end coupled to the top surface of the base plate near the top edge thereof and the other end upwardly extended therefrom and adapted to be coupled to the surface of a pitched roof for maintaining the pedestal at a given location.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved adjustable roofing stool which has all the advantages of the prior art roof supports and none of the disadvantages.

It is another object of the present invention to provide a new and improved adjustable roofing stool which may be easily and efficiently manufactured and marketed.

It is a further object of the present invention to provide a new and improved adjustable roofing stool which is of durable and reliable construction.

An even further object of the present invention is to provide a new and improved adjustable roofing stool which is susceptible of a low cost of manufacture with regard to both materials and labor, and which accordingly is then susceptible of low prices of sale to the consuming public, thereby making such an adjustable roofing stool economically available to the buying public.

Still yet another object of the present invention is to provide a new and improved adjustable roofing stool which provides in the apparatuses and methods of the prior art some of the advantages thereof, while simultaneously overcoming some of the disadvantages normally associated therewith.

Even still another object of the present invention is to provide a new and improved adjustable roofing stool for supporting a person and materials on a pitched roof.

Lastly, it is an object of the present invention to provide a new and improved adjustable roofing stool comprising a pedestal adapted to be placed in contact with the surface of a pitched roof; a seat adapted for supporting personnel and materials thereon; coupling means for pivotally coupling the pedestal to the seat positioning means coupled between the pedestal and seat for fixing the angular orientation of the seat relative to the pedestal; and securable means for coupling the pedestal to the surface of a pitched roof for maintaining the pedestal at given location.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
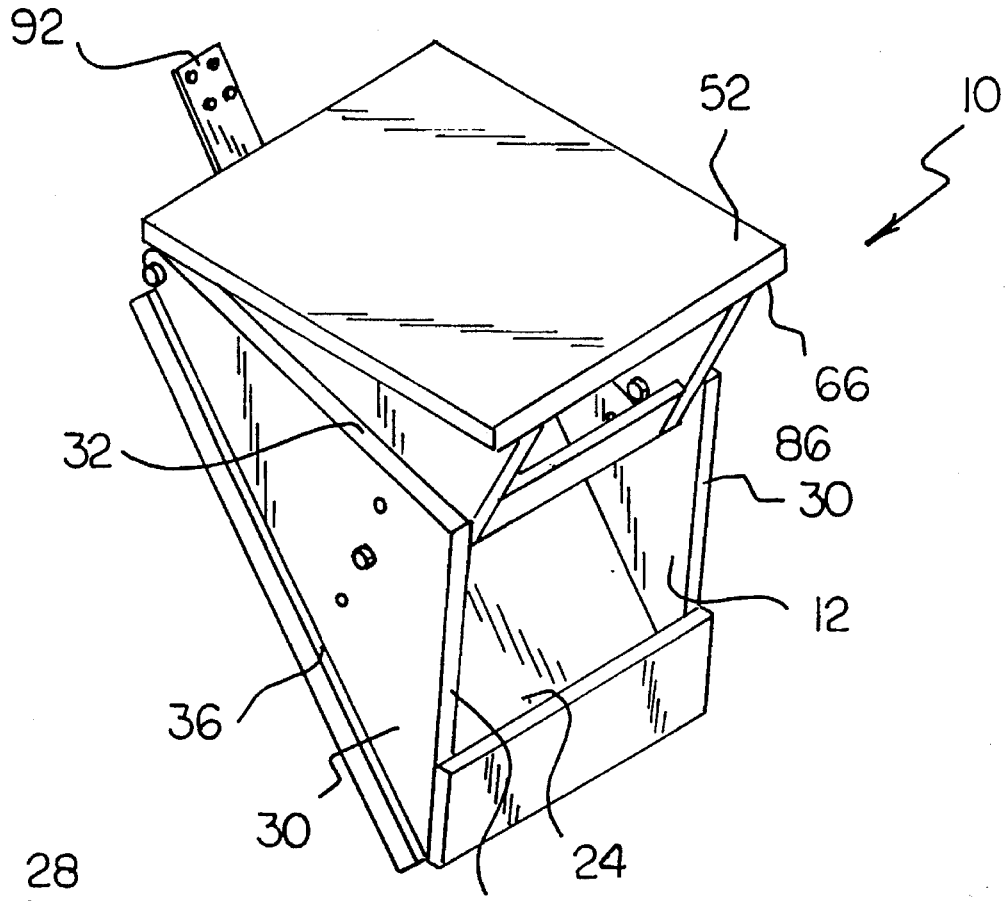
FIG. 1 is a perspective view of the preferred embodiment of the adjustable roofing stool constructed in accordance with the principles of the present invention.
Figure 2:
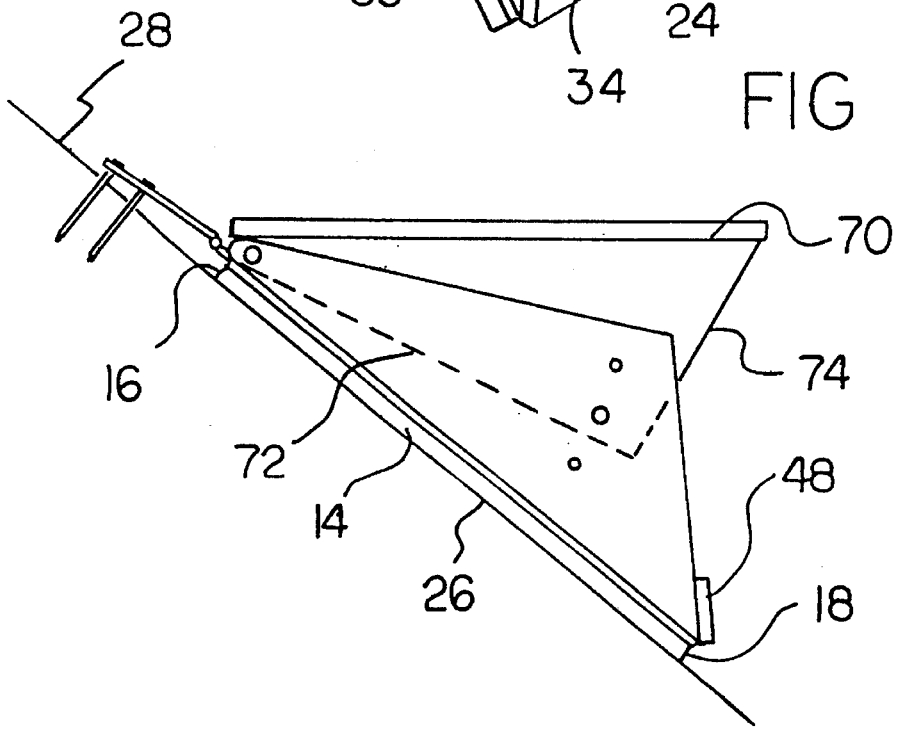
FIG. 2 is a side elevational view of the present invention shown in FIG. 1.

With reference now to the drawings, and in particular, to FIG. 1 thereof, the preferred embodiment of the new and improved adjustable roofing stool embodying the principles and concepts of the present invention and generally designated by the reference number 10 will be described.

Specifically, the present invention includes 5 major components. The major components are pedestal, seat, coupling means, positioning means, and hinge. These components are interrelated to provide the intended function.

More specifically, it will be noted in the various Figures that the first major component is the pedestal 12. A pedestal includes three subcomponents. The subcomponents are the base plate, outer legs, and cross bar. These subcomponents are interrelated to provide the intended function.

The first subcomponent of the pedestal is the base plate 14. The base plate is rectangular and rigid in structure. The base plate has opposed top and bottom edges 16, 18 and opposed side edges 20, 22. The base plate also has a top surface 24 and a bottom surface 26. The bottom surface is adapted to be placed in contact with the surface 28 of a pitched roof.

The second subcomponent of the pedestal is the outer legs 30. The present invention includes a pair of outer legs. The outer legs are triangularly shaped and rigid in structure. They are symmetrically spaced and oriented in parallel. Each outer leg has an upper edge 32, a lower edge 34, and a rear edge 36 defined about its periphery. Each outer leg also has a front corner 38 defined between the upper edge and the lower edge, a lower corner 40 defined between the lower edge and the rear edge, and upper corner 42 defined between the upper edge and the rear edge. The rear edges of the outer legs are coupled to the top surface 24 of the base plate near its side edges 20, 22.

Furthermore, the outer legs have a pair of symmetrically aligned pivot holes 44. Each pivot hole is disposed on each outer leg near its upper corner 42. The outer legs also have a plurality of symmetrically aligned pairs of adjustment holes 46. The adjustment holes are disposed on the outer legs and spaced in curvature with respect to the pivot hole 44. The adjustment holes are positioned on the outer leg between the front corner 38 and the rear edge 36.

The third subcomponent of the pedestal is the cross bar 48. The cross bar is coupled across the lower edges 34 of the outer legs 30 near the lower corners 40 thereof. The cross bar, outer legs, and base plate 14 define a storage pocket 50 adapted for holding tools and equipment therein.

The second major component is the seat 52. The seat includes three subcomponents. The subcomponents are the plate, inner legs, and support bar. These subcomponents are interrelated to provide the intended function.

The first subcomponent of the seat is the plate 54. The plate is rectangular, planar, and rigid in structure. The plate has opposed top and bottom edges 56, 58 and opposed side edges 60, 62. The plate also has a top surface 64 and a bottom surface 66. The top surface of the plate is adapted to support a person and materials thereon.

The second subcomponent of the seat is the inner legs 68. The present invention includes a pair of inner legs. The inner legs are triangularly shaped and rigid in structure. They are symmetrically spaced and oriented in parallel. Each inner leg has a top edge 70, a bottom edge 72, and a front edge 74 defined about its periphery. Each leg also includes a front corner 76 defined between the top edge and the front edge, a bottom corner 78 defined between the front edge and the bottom edge, and a rear corner 80 defined between the top edge and the bottom edge. The top edges 70 are coupled to the bottom surface 66 of the seat near its side edges 60, 62.

Furthermore, the inner legs have a pair of symmetrically aligned adjustment holes 82. Each adjustment hole is disposed on each inner leg 68 near the bottom corner 78 thereof. Each inner leg also includes a pair of symmetrically aligned pivot holes 84. Each pivot hole is disposed on each inner leg near the rear corner 80 thereof.

The third subcomponent of the seat is the support bar 86. The support bar is elongated and rigid in structure. It is coupled between the inner legs 68 of the seat between the bottom corners 78 thereof. The support bar is used to keep the inner legs of the seat in a spaced and upright orientation.

The third major component is the coupling means 88. The coupling means is disposed within the pivot holes 44 on the pedestal and the pivot holes 84 on the seat. The coupling means pivotally couples the pedestal to the seat. The coupling means consists of a bolt with a nut threaded thereon.

The fourth major component is the positioning means 90. The positioning means is disposed within a pair of adjustment holes 46 on the pedestal 12 and the adjustment holes 82 on the seat 52. The positioning means fixes the angular orientation of the seat relative to the pedestal. The positioning means consists of a bolt with a nut threaded thereon.

The fifth major component is the hinge 92. The hinge is elongated and rigid in structure. It has one end coupled to the top surface 24 of the base plate near the top edge 16 thereof. The other end of the hinge is upwardly extended from the top edge of the base plate and adapted to be coupled to the surface 28 of a pitched roof. The hinge is used for maintaining the pedestal at a given location on the surface of a pitched roof.

Figure 3:
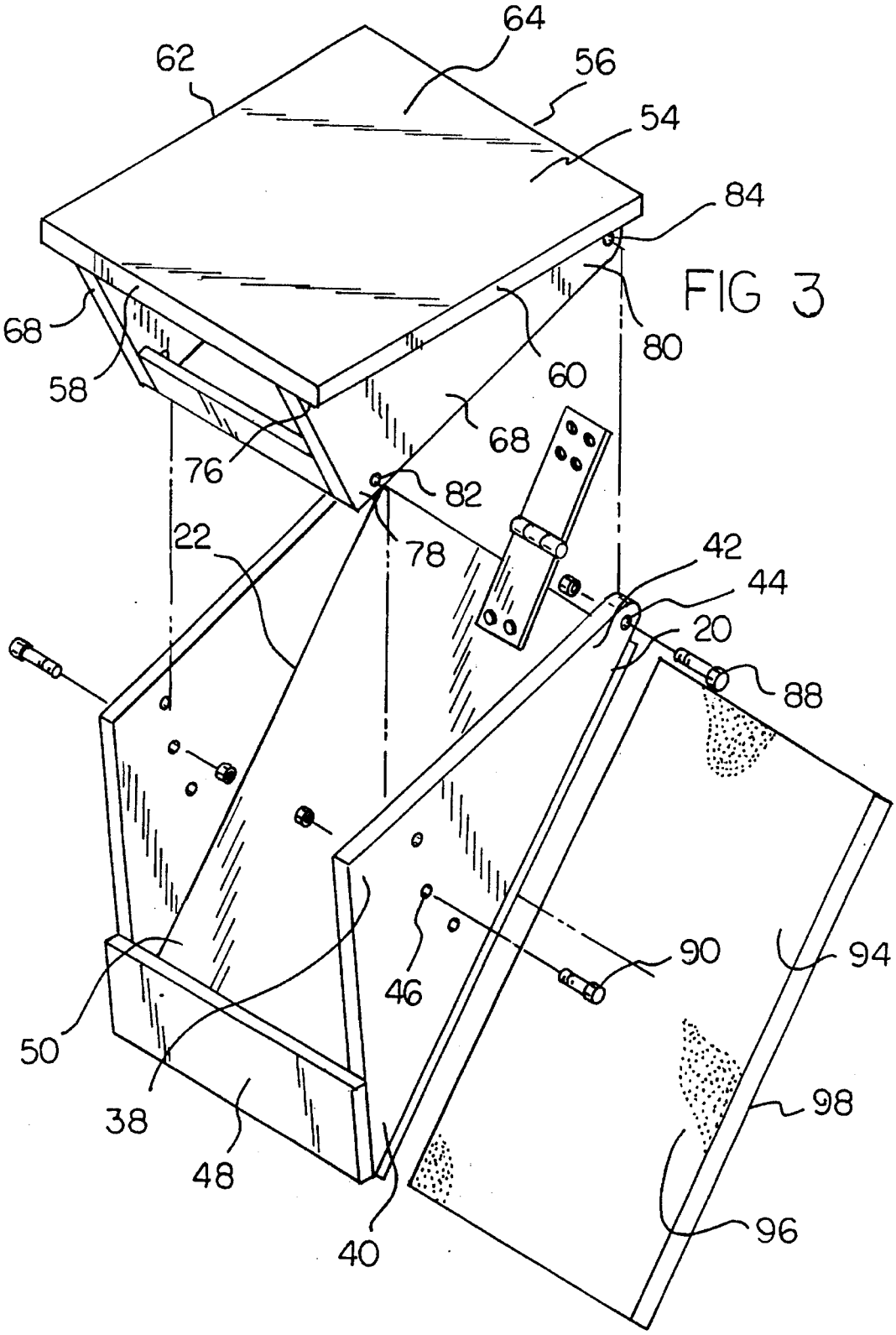
FIG. 3 is an exploded front perspective view of an alternate embodiment of the present invention.

A second embodiment of the present invention is shown in FIG. 3 and includes substantially all of the components of the present invention further including an elastomeric plate 94. The elastomeric plate has a top surface 96 and a bottom surface 98. The top surface is coupled to the bottom surface 26 of the base plate. The bottom surface of the elastomeric plate is adapted to be placed in contact with and grip a pitched roof to ensure that the pedestal 12 does not slip.

Figure 4:
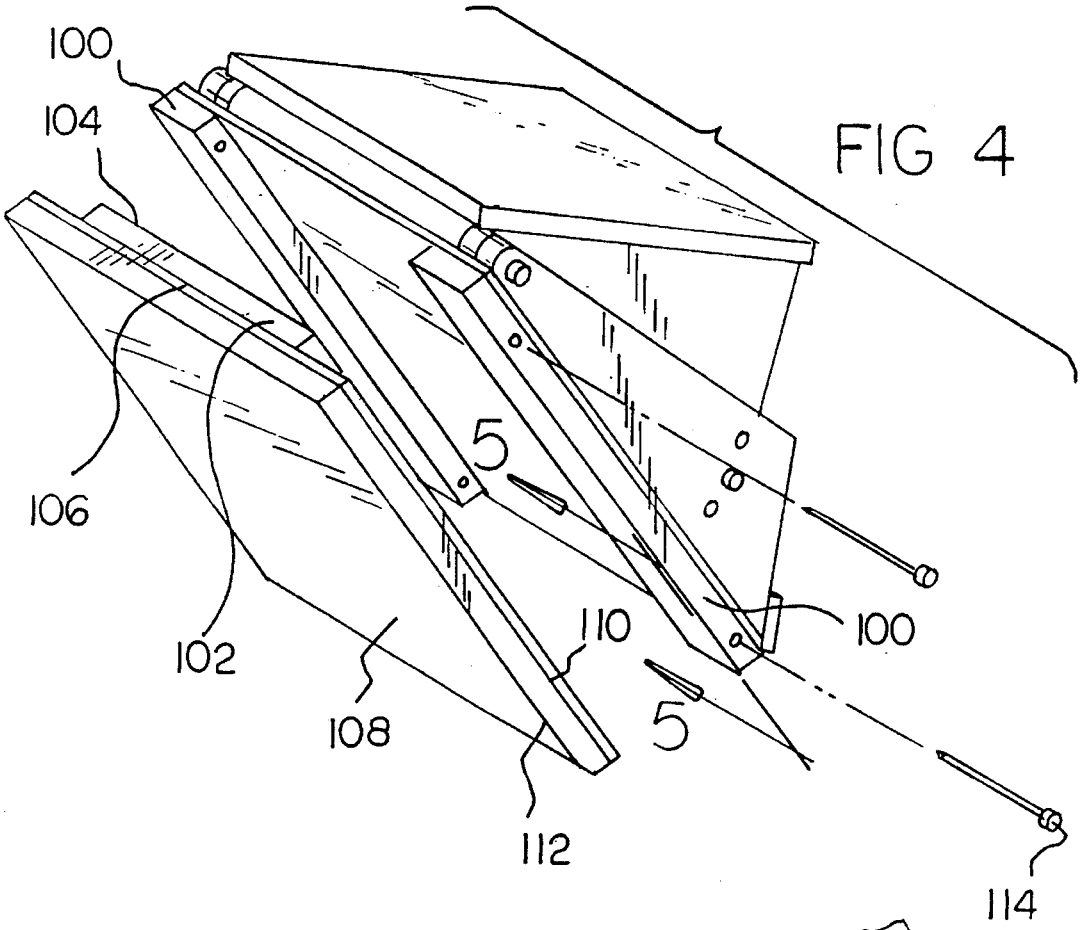
FIG. 4 is an exploded rear perspective view of yet another alternate embodiment of the present invention.

The third embodiment of the present invention is shown in FIG. 4 and includes substantially all components of the present invention further including several additional components. The additional components are the backing rails, backing plate, elastomeric plate, and removable coupling means. These components are interrelated to provide the intended function.

The third embodiment includes backing rails 100. A pair of backing rails are used. The backing rails are elongated and rigid in structure. They are spaced apart from each other and oriented in parallel. Each rail is coupled to the bottom surface 26 of the base plate 14 near a side edge thereof.

The third embodiment includes a backing plate 102. The backing plate has a top surface 104 and a bottom surface 106. The top surface is adapted to be placed in contact against the bottom surface 26 of the base plate and between the backing rails 100.

The third embodiment includes an elastomeric plate 108. The elastomeric plate has a top surface 110 and a bottom surface 112. The top surface of the elastomeric plate is coupled to the bottom surface 106 of the backing plate. The bottom surface of the elastomeric plate is adapted to be placed in contact with the surface 28 of a pitched roof to ensure that the pedestal 12 does not slip.

The third embodiment also includes removable coupling means 114. The removable coupling means allow the backing plate 102 to be coupled between the backing rails 100 in one orientation. The removable coupling means also allows the backing plate and associated elastomeric plate to be removed from the backing rails in another orientation. The removable coupling means may consist of a plurality of tacks.

Figure 5:
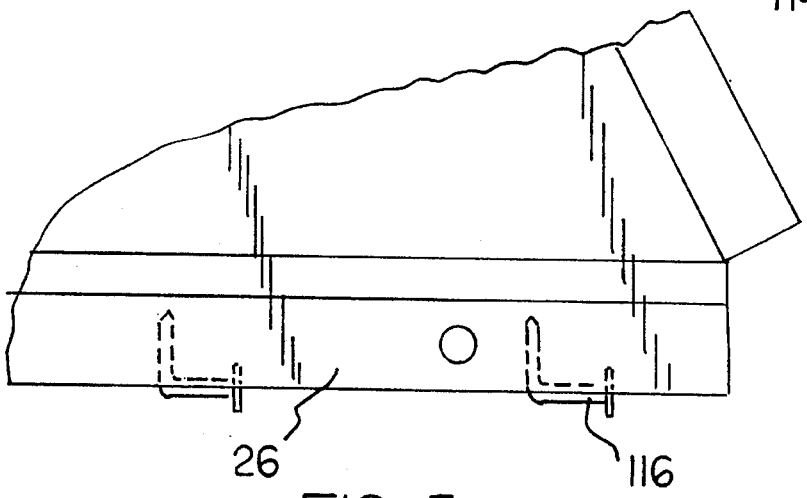
FIG. 5 is a enlarged side elevational view of the protrusions used to grip a pitched roof in yet another alternate embodiment of the present invention.

A fourth embodiment of the present invention is shown in FIG. 5. This embodiment includes substantially all the components of the preferred embodiment including a plurality of rigid protrusions 116. The protrusions are extended from the bottom surface 26 of the base plate. They are adapted for allowing the pedestal 12 to grip the surface 28 of a pitched roof. The protrusions may consist of a plurality of bent nails.

The present invention is designed for use by roofers, painters, homeowners, and others who have the need to climb onto pitched roofs. The purpose of the present invention is to support a person and/or materials on a pitched, shingled roof. Roofing jacks are currently used for this purpose. However, roofing jacks are not entirely satisfactory—the nails that support them sometimes come loose, causing the jack to slip. In addition, roofing jacks are normally not adjustable and offer no storage space. The present invention overcomes these deficiencies.

The present invention could be made from a variety of rigid materials ranging from plywood to plastic or fiberglass. The present invention consists of a seat with triangular legs about a foot wide at the top edge. The longest side of the triangular leg is the bottom which rests on a base. This base is placed against the surface of the pitched roof. Security and stability is provided by a metal hinge along the top edge of the base plate of the pedestal. A rigid metal or flexible strap hinge can be nailed to the roof for added safety. The metal hinge will work best if parallel to and in contact with the roof. The hinge should also be several inches long. Three or four nails are used to secure the pedestal to the surface of the pitched roof. A metal strap could also be used in lieu of a rigid metal hinge.

The plate of the stool on which the user works pivots and can be adjusted up or down to compensate for the pitch of the roof. This adjustment is performed by removing the bolt that holds the seat in place, adjusting the seat so that the bolt holes line up with a higher or lower pair of pivot holes on each side of the legs of the seat. The bolts are then replaced to reestablish the rigid connection between the seat and pedestal.

Several different mechanisms may be utilized in order for the pedestal to grip the surface of a pitched roof. In one case, small, sharp metal protrusions about ⅛ inch in length would be coupled to the base plate and would keep the stool from slipping on wood shingles. The metal protrusions would cover the base plate at an angle perpendicular to the ground. For this design, screws could be screwed into the bottom piece so that the ends would come out the side facing the roof. The pattern and number of protrusions is variable.

In another case, the base plate would be eliminated. The small, sharp metal protrusions would then be coupled to the bottom edges of the legs keep the stool from slipping on wood shingles. A simple way to create these protrusions is to use nails which have a thin, large head of about ¼ inch or more in diameter. The edges of the head must be sharp. The nails would be nailed halfway into the bottom of the pedestal or sides of the seat contact. The visible part of the nail would be bent toward the front of the stool so that the visible stem of the nail would be even with the wood and the head would be halfway inside and perpendicular to the wood. The protruding part of the nail head which is extended outwards form the present invention about ⅛ inch would keep the stool from sliding on wood shingles.

In yet another case, a layer of foam is glued to the base plate of the pedestal. Several screws could also be used to firmly secure the added layer of material to the base plate of the pedestal. A slight modification to this case would involve the addition of a replaceable bottom portion coupled to the layer of foam in order to make the stool adaptable for use on composition or wood shingles. Angle irons could be attached to the legs of the pedestal so that the bottom portion could be bolted to the pedestal and replaced when necessary. This would also make it possible to replace a foam bottom which has worn out.

A pocket is provided for storing tools. In order to increase the storage space of the pocket, the cross bar attached legs of the pedestal could be extended. A smaller cross bar could be pivotally coupled to the base plate below the metal hinge to seal and prevent unwanted entry to the pocket. A lock could be added to secure the seat to the pedestal to define a stowed configuration. A handle added to one side of the stool would allow the stool to be carried from place to place.

In addition, two of the stools can be spaced apart with a board bridging across them. This configuration provides a larger and more efficient work surface and designed for the safety conscious user. It takes up little space and is completely portable. The board could be secured to the top of each stool in one or two places for added stability. One or two holes would need to be drilled in the plate of the seat and in each side of the board to provide a place for a bolt to be inserted. Boards used to hold personnel and materials could be made of metal or similar rigid and durable materials. However, if a roofer is to sit on or have other contact with the seat, the upper portion would have to be made of wood or other materials that would not get too hot in the summer sun.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by LETTERS PATENT of the United States is as follows:

1. An adjustable roofing stool for supporting a person and materials on a pitched roof comprising, in combination:

a pedestal further comprising:

a rectangular base plate having opposed top and bottom edges, opposed side edges, a top surface, and a bottom surface with the bottom surface adapted to be placed in contact with the surface of a pitched roof;

a pair of parallel, symmetrically spaced, and triangularly-shaped outer legs, each outer leg having an upper edge, a lower edge, and a rear edge defined about its periphery, a front corner defined between the upper edge and the lower edge, a lower corner defined between the lower edge and the rear edge, and an upper corner defined between the upper edge and the rear edge with the rear edges of the outer legs coupled to the top surface of the base plate near the side edges thereof, the outer legs further having a pair of symmetrically aligned pivot holes with each pivot hole disposed on each outer leg near the upper corner thereof and a plurality of symmetrically aligned pairs of adjustment holes with the adjustment holes disposed and spaced in curvature with respect to the pivot hole on each outer leg between the front corner and the rear edge thereof; and a cross bar coupled across the lower edges of each outer leg near the lower corner thereof with the cross bar, outer legs, and base plate defining an essentially storage pocket adapted for holding tools and equipment therein;

a seat further comprising:

a rectangular and planar plate having opposed top and bottom edges, opposed side edges, a top surface, and a bottom surface with the top surface of the plate adapted to support a person and materials thereon;

a pair of parallel, symmetrically spaced, and triangularly-shaped inner legs, each inner leg having a top edge, a bottom edge, and a front edge defined about its periphery, a front corner defined between the top edge and the front edge, a bottom corner defined between the front edge and the bottom edge, and a rear corner defined between the top edge and bottom edge with the top edges coupled to the bottom surface of the seat near the side edges thereof, the inner legs further having a pair of symmetrically aligned adjustment holes with each adjustment hole disposed on each inner leg near the bottom corner thereof and a pair of symmetrically aligned pivot holes with each pivot hole disposed on each inner leg near the rear corner thereof; and an elongated support bar coupled between the inner legs near the bottom corners thereof;

coupling means disposed within the pivot holes on the pedestal and the pivot holes on the seat for pivotally coupling the pedestal to the seat;

positioning means disposed within a pair of adjustment holes on the pedestal and the adjustment holes on the seat for fixing the angular orientation of the seat relative to the pedestal; and an elongated hinge having one end coupled to the top surface of the base plate near the top edge thereof and the other end upwardly extended therefrom and adapted to be coupled to the surface of a pitched roof for maintaining the pedestal at a given location;

an elastomeric plate having a top surface and a bottom surface with the top surface coupled to the bottom surface of the base plate and the bottom surface thereof adapted to be placed in contact with the surface of a pitched roof; and a plurality of rigid protrusions extended from the bottom surface of the base plate and adapted for gripping a pitched roof.

2. An adjustable roofing stool for supporting a person and materials on a pitched roof comprising, in combination:

a pedestal further comprising:

a rectangular base plate having opposed top and bottom edges, opposed side edges, a top surface, and a bottom surface with the bottom surface adapted to be placed in contact with the surface of a pitched roof;

a pair of parallel, symmetrically spaced, and triangularly-shaped outer legs, each outer leg having an upper edge, a lower edge, and a rear edge defined about its periphery, a front corner defined between the upper edge and the lower edge, a lower corner defined between the lower edge and the rear edge, and an upper corner defined between the upper edge and the rear edge with the rear edges of the outer legs coupled to the top surface of the base plate near the side edges thereof, the outer legs further having a pair of symmetrically aligned pivot holes with each pivot hole disposed on each outer leg near the upper corner thereof and a plurality of symmetrically aligned pairs of adjustment holes with the adjustment holes disposed and spaced in curvature with respect to the pivot hole on each outer leg between the front corner and the rear edge thereof; and a cross bar coupled across the lower edges of each outer leg near the lower corner thereof with the cross bar, outer legs, and base plate defining an essentially storage pocket adapted for holding tools and equipment therein;

a seat further comprising:

a rectangular and planar plate having opposed top and bottom edges, opposed side edges, a top surface, and a bottom surface with the top surface of the plate adapted to support a person and materials thereon;

a pair of parallel, symmetrically spaced, and triangularly-shaped inner legs, each inner leg having a top edge, a bottom edge, and a front edge defined about its periphery, a front corner defined between the top edge and the front edge, a bottom corner defined between the front edge and the bottom edge, and a rear corner defined between the top edge and bottom edge with the top edges coupled to the bottom surface of the seat near the side edges thereof, the inner legs further having a pair of symmetrically aligned adjustment holes with each adjustment hole disposed on each inner leg near the bottom corner thereof and a pair of symmetrically aligned pivot holes with each pivot hole disposed on each inner leg near the rear corner thereof; and an elongated support bar coupled between the inner legs near the bottom corners thereof;

coupling means disposed within the pivot holes on the pedestal and the pivot holes on the seat for pivotally coupling the pedestal to the seat;

positioning means disposed within a pair of adjustment holes on the pedestal and the adjustment holes on the seat for fixing the angular orientation of the seat relative to the pedestal;

an elongated hinge having one end coupled to the top surface of the base plate near the top edge thereof and the other end upwardly extended therefrom and adapted to be coupled to the surface of a pitched roof for maintaining the pedestal at a given location;

a pair of elongated, spaced, and parallel backing rails with each rail coupled to the bottom surface of the base plate near a side edge thereof;

a backing plate having a top surface and a bottom surface with the top surface adapted to be placed in contact against the bottom surface of the base plate and between the backing rails;

an elastomeric plate having a top surface and a bottom surface with the top surface coupled to the bottom surface of the backing plate and the bottom surface thereof adapted to be placed in contact with a roof; and removable coupling means for allowing the backing plate to be coupled between the backing rails in one orientation and allowing the backing plate to be removed in another orientation.

* * * * *